US007658016B2

(12) United States Patent
Schulkin

(10) Patent No.: US 7,658,016 B2
(45) Date of Patent: Feb. 9, 2010

(54) APPARATUS FOR HANG-DRYING WET GARMENTS

(76) Inventor: Elaine M. Schulkin, 1382 Ocean Ave., Unit B10, Sea Bright, NJ (US) 07760

( * ) Notice: Subject to any disclaimer, the term of this patent is extended or adjusted under 35 U.S.C. 154(b) by 397 days.

(21) Appl. No.: 11/555,867

(22) Filed: Nov. 2, 2006

(65) Prior Publication Data

US 2008/0105716 A1 May 8, 2008

(51) Int. Cl.
*F26B 25/18* (2006.01)

(52) U.S. Cl. ..... 34/239; 34/103; 223/85; 223/87; 223/90; 223/92; 223/98

(58) Field of Classification Search ..... 34/104, 34/103, 239; 223/85, 87, 89, 90, 91, 92, 223/93, 94, 98; 24/716
See application file for complete search history.

(56) References Cited

U.S. PATENT DOCUMENTS 2,057,045 A * 10/1936 Moore ..... 223/87
2,813,668 A * 11/1957 Griffis ..... 223/98
4,613,066 A 9/1986 Saucy
4,632,287 A * 12/1986 Bevelander ..... 223/98
5,139,184 A 8/1992 Seitz
5,577,645 A 11/1996 Seitz
5,950,882 A 9/1999 Scott
6,041,517 A * 3/2000 Wang ..... 34/439
6,053,379 A 4/2000 Balph
6,068,166 A 5/2000 Kilian et al.
6,269,989 B1 8/2001 Kiselik
6,409,058 B1 6/2002 Lam et al.
6,581,810 B1 6/2003 Ho
6,688,503 B2 2/2004 Viazanko et al.
6,922,911 B2 8/2005 Lam

FOREIGN PATENT DOCUMENTS

GB 2206783 A * 1/1989

* cited by examiner

*Primary Examiner*—Kenneth B Rinehart
*Assistant Examiner*—Corey Hall
(74) *Attorney, Agent, or Firm*—Patterson & Sheridan, LLP; Keith P. Taboada

(57) ABSTRACT

Embodiments of an apparatus for facilitating drying of a garment on a garment hanger are provided. In one embodiment, an apparatus for drying a garment on a garment hanger includes an elongated body comprised of a water resistant material. The body has a major axis extending between a first end and a second end. The body is configured to be repeatably changed between a substantially flat and a substantially tubular orientation. An elongated aperture formed in the first end of the elongated body to allow passage of the hook of the garment hanger through the body.

18 Claims, 7 Drawing Sheets

APPARATUS FOR HANG-DRYING WET GARMENTS

FIELD OF THE INVENTION

Embodiments of the invention generally relate to an apparatus for hang drying damp garments. More specifically, a hanger assembly suitable for drying damp sweaters thereon.

BACKGROUND OF THE INVENTION

Hand and machine washed sweater, along with other high-loft fabrics, generally retain a significant amount of moisture at the end of the cleaning cycle. To prevent the fabric from being pulled out of shape, such garments are typically dried flat or hung on wire hangers or poles. However, drying a large number of sweaters on a flat surface is often inconvenient due to the large surface area required to lay out the garments. The use of wires or poles, although being space-efficient, generally transfers a crease or set to the garment due to the weight of the fabric pulling against the small radius or fold. Since the crease or imprinted radius left on the garment after drying detracts from its appearance, it would be beneficial to have a drying apparatus which does not leave such markings.

Therefore, there is a need for an improved apparatus for drying damp garments.

SUMMARY OF THE INVENTION

Embodiments of an apparatus for facilitating drying of a garment on a garment hanger are provided. In one embodiment, an apparatus for drying a garment on a garment hanger includes an elongated body comprised of a water resistant material. The body has a major axis extending between a first end and a second end. The body is configured to be repeatably changed between a substantially flat and a substantially tubular orientation. An elongated aperture formed in the first end of the elongated body to allow passage of the hook of the garment hanger through the body.

In another embodiment, an apparatus for drying a garment on a garment hanger includes a pair of elongated bodies comprised of water resistant sheets, each the body having a major axis extending between a first end and a second end, and each body having an aperture formed in the first end configured to allow a hook of the garment hanger to pass therethrough.

In yet another embodiment, an apparatus for drying a garment on a garment hanger includes a pair of elongated bodies and securing means. Each body is comprised of a water resistant polymer sheet and has length defined a major axis extending between a first end and a second end greater than about 12 inches, for example, at least 24 inches, and in another embodiment, at least 30 inches. Each body also has an aperture formed in the first end configured to allow a hook of the garment hanger to pass therethrough. Each body is reconfigurable between a substantially flat first orientation and a substantially tubular second orientation. The securing mean are configured to retain the body in the second orientation. The securing means is at least one of a strap, a band, a snap, a latch, a hook, tape, a magnet, hook and loop fastener, mating features disposed on opposite edges of the body.

DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures. It is contemplated that features from any one embodiment may be beneficially incorporated in other embodiments without additional recitation.

DETAILED DESCRIPTION

Figure 1:
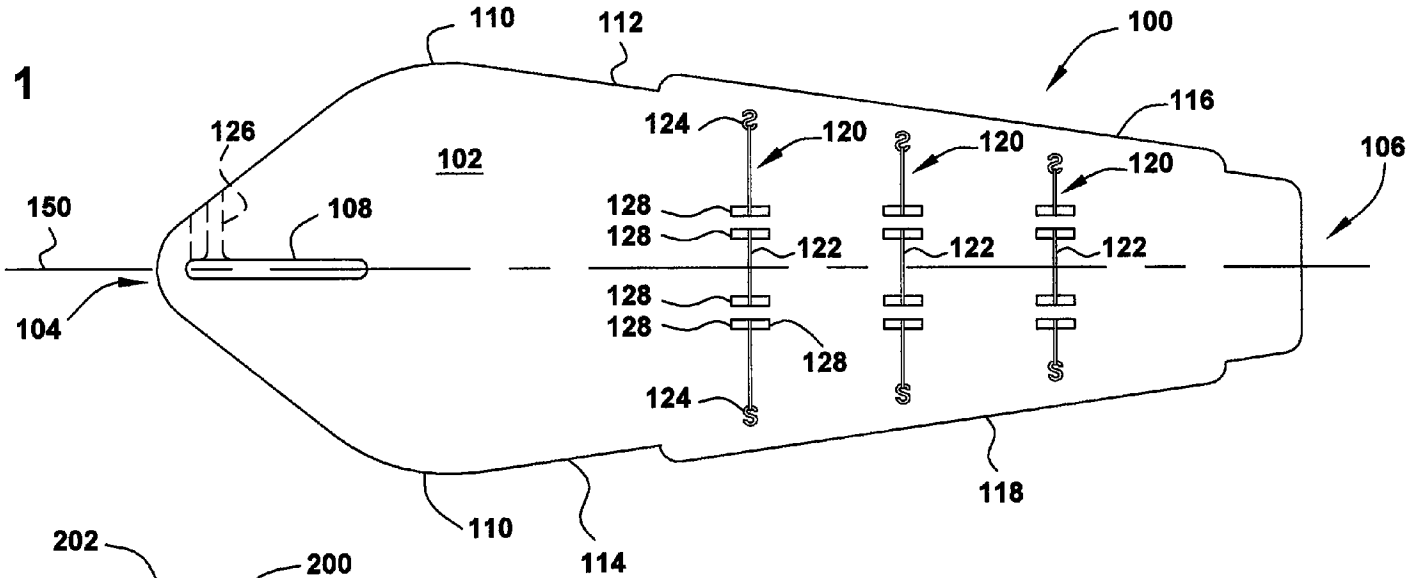
FIG. 1 is a plan view of one embodiment of an apparatus, also referred herein as a tube assembly, for hang-drying wet garments shown in a flat orientation.
Figure 2:
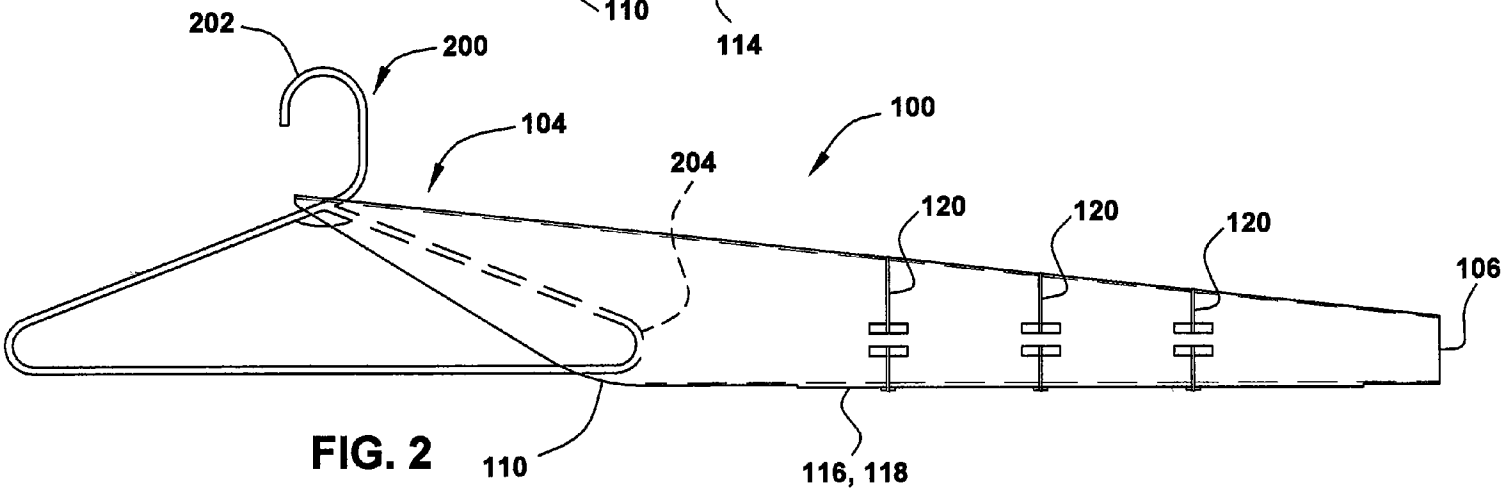
FIG. 2 is a side view of the tube assembly of FIG. 1 engaged with a garment hanger.
Figure 3:
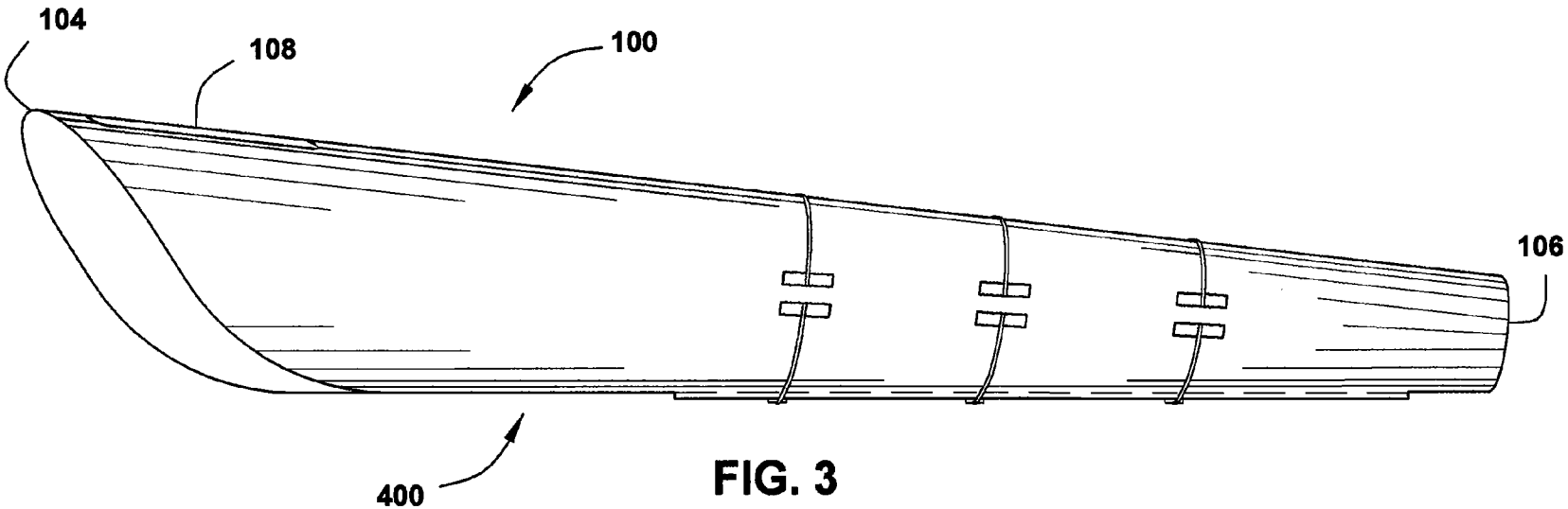
FIG. 3 is a side perspective of the tube assembly of FIG. 1 in a rolled orientation.
Figure 4:
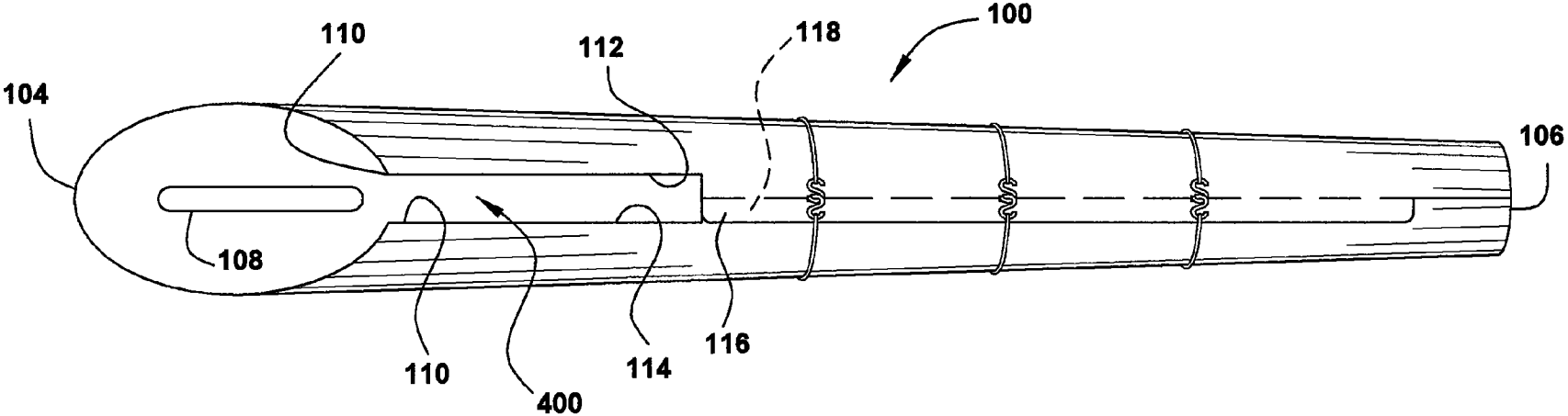
FIG. 4 is a bottom view of the tube assembly of FIG. 1 in a rolled orientation.
Figure 5:
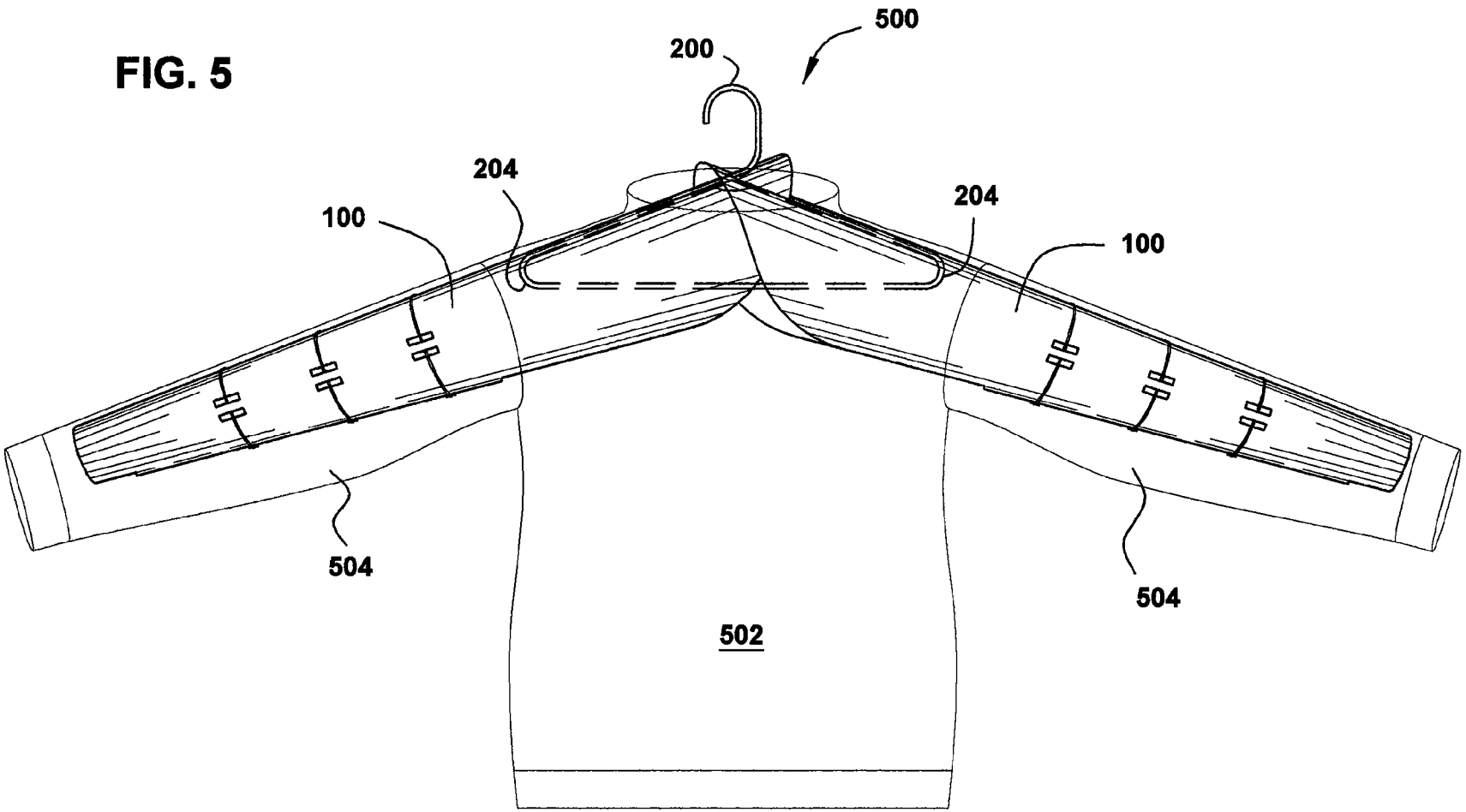
FIG. 5 is a side view of two tube assemblies engaged with a garment hanger.

FIG. 1 is one embodiment of a tube assembly 100 which may be utilized with a clothes hanger to provide an apparatus suitable for drying sweaters. The tube assembly 100 is shown in a substantially flat storage configuration in FIG. 1, while FIGS. 2-4 depict the tube assembly 100 in a rolled, substantially tubular orientation. The tube assembly 100 may have a cylindrical, tapered conical or other configuration when in the rolled orientation. FIG. 2 depicts a single tube assembly 100 engaged with a hanger 200 while FIG. 5 depicts two tube assemblies engaged with a hanger 200 to provide an apparatus 500 suitable for drying a garment 502 thereon. The reader is encouraged to refer to FIGS. 1-5 for the best understanding of the first and other embodiments described herein.

The tube assembly 100 generally includes a body 102 which is sufficiently resilient to allow repeated deformation between a substantially flat orientation, as shown in FIG. 1, and a rolled, tubular orientation, as shown in FIGS. 2-5. In the flat orientation, the body 102 may be efficiently stored. The body 102 is generally fabricated from a water-resistant material, such as a plastic sheet. Some suitable plastic sheets include polyester and polypropylene, among others. Alternatively, metal foils, treated or coated paper board products or other suitable water-resistant material may be utilized.

In the embodiment depicted in FIG. 1, the body 102 is elongated along a major axis 150 defined between a head 104 and a distal end 106. The body 102 generally has a length at least as long as ½ the length of a conventional garment hanger. For example, the body 102 may have a length along the major axis 150 of at least at 6 inches (for drying sleeveless garments), or at least 12 inches (or drying long sleeve garments). In another embodiment, the body 102 has a length along the major axis 150 of at least at 24 inches, and in another embodiment, at least at 30 inches.

Sides 112, 114 of the body 102 generally form a shoulder 110 at the widest portion. The sides 112, 114 of the body 102 taper from the shoulder 110 toward the head 104. The sides 112, 114 of the body 102 also taper from the shoulder 110 toward the distal end 106.

An aperture 108 is formed through the body 102 proximate the head 104. The aperture 108 is generally configured to allow a hook 202 of the hanger 200 to pass therethrough. The aperture 108 may be configured as a slot having an elongated orientation along the major axis 150 of the body 102. Alternatively, the aperture 108 may be opened to one of the sides 112, 114 of the body 102 by a cut-out 126 (shown in phantom) to allow the hook 202 to enter the aperture 108 without having to be "snaked" through the body 102.

In one embodiment, a portion of at least one of the sides 112, 114 defined between the shoulder 110 and the distal end 106 includes a tab extending therefrom. In the embodiment depicted in FIG. 1, a first tab 116 extends from the first lateral side 112, while a second tab 118 extends from the second lateral side 114. When the body 102 is rolled into a tubular orientation, as shown in FIG. 4, the tabs 116, 118 overlap such that a slot 400 is defined between the facing lateral sides 112, 114. The slot 400 is bounded at its closed end by the overlapping tabs 116, 118. The open end of the slot 400 is proximate the shoulder 110. The slot 400 allows room for an outer bend 204 of the hanger 200 to be positioned within the rolled tube assembly 100 when the body 102 is engaging and disengaging the hook 202 of the hanger 200.

The tube assembly 100 is retained in the rolled position by one or more fastening features 120. In the embodiment depicted in FIG. 1, the fastening features 120 are a plurality of cords 122. Each cord 122 includes at least one hook 124 which may be utilized to retain the body 102 in a rolled position. In the embodiment depicted in FIG. 1, both the first and second ends of the cord 122 include hooks 124. Alternatively, the cord 122 may have a single hook 124 coupled to the first end of the cord 122 and a loop for engaging the hook 124 disposed at the opposite end of the cord 122. As the tube assembly 100, depicted in FIGS. 1-5, tapers toward the distal end 106 after rolling, the cords 122 closer to the distal end 106 may be progressively shorter in length.

The apparatus 500 is assembled by first disposing a garment 502, such as a wet sweater, on the garment hanger 200. The distal end 106 of the first tube assembly 100 is first slid down a sleeve 504 of the garment 502. The aperture 108 of the first tube assembly 100 is then slid over the hook 202 of the hanger 200. A second tube assembly 100 is then slid down the other sleeve 504 of the garment 502. The hook 202 of the hanger 200 is then passed through the aperture 108 of the second tube assembly 100. The elongated orientation of the aperture 108 allows one tube assembly to ride over the other tube assembly. The weight of the wet garment pushes both of the tube assemblies 100 down onto the hanger, and while doing this, the head 104 of the one tube 100 slides into the aperture 108 of the other tube assembly 100, as shown in FIG. 5. The curved orientation of the head of the first tube assembly is within the interior of the second tube assembly with little interference.

As the diameter of the rolled tube assembly is much greater than the diameter of the wire comprising the hanger 200, the garment 502 is unlikely to be creased when drying. Moreover, since the elongated length of the tube assembly 100 may be much greater in length than the width of the hanger 200, the tube assembly 100 extends substantially through the entire length of the sleeve 504 of the garment 502, thereby preventing creases in the garment as the sleeve or shoulder of the garment cannot droop over the outer bend 204.

Since the apparatus 500 allows the garment 502 to be dried in a substantially vertical plane, multiple garments may be dried without an extensive use of drying area. Additionally, as the rolled tube assembly 100 may be returned to a substantially flat position once disassembled from the hanger 200, the flattened tube assembly 100 may be conveniently stored without occupying excessive storage space.

Figure 6:
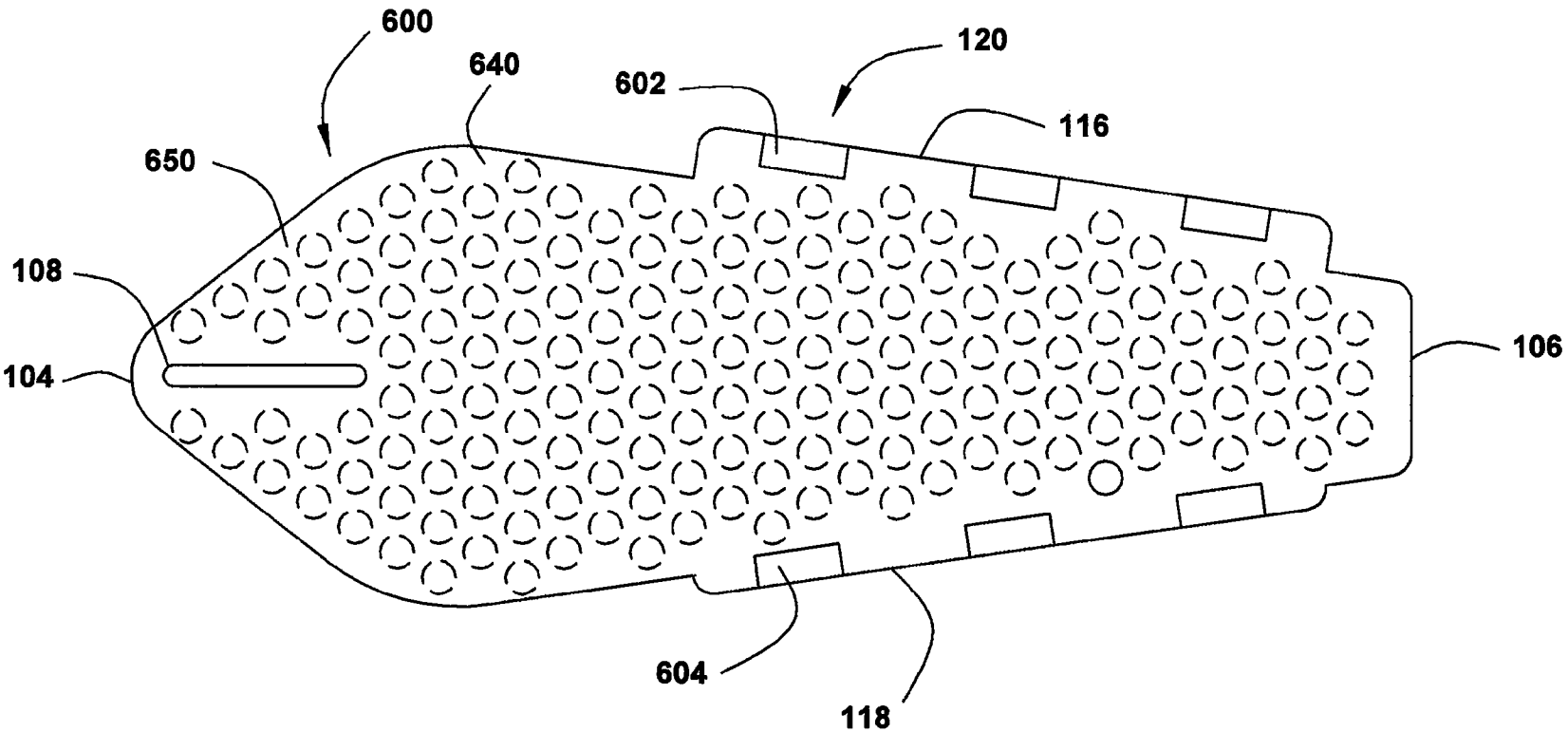
FIG. 6 is a plan view of another embodiment of a tube assembly for hang-drying wet garments shown in a flat orientation.

FIG. 6 depicts another embodiment of a tube assembly 600. The tube assembly 600 is essentially similar to the tube assembly 100 depicted in FIG. 1, except wherein the fastening features 120 are comprised of a hook and loop fastener, such as VELCRO®. For example, a hook portion 602 of the fastening feature 120 may be disposed in a first tab 116 while the loop portion 604 of the mating portion of the fastening feature 120 may be disposed on the second tab 118. As the tube assembly 600 is rolled, the tabs 116,118 over lay, allowing the hook portion 602 to engage the loop portion 604, thereby securing the tube assembly 600 in a rolled orientation.

In the embodiment, depicted in FIG. 6, a body 640 of the tube assembly 600 may include a plurality of perforations 650 extending between the head 104 and distal end 106. The perforations 650 promote air circulation during drying of the garment, thereby reducing the drying time. The perforations 650 may have any shape, spacing or open area. In one embodiment, the perforations 650 may be such as to define the body 640 as a mesh or web of material.

Figure 7:
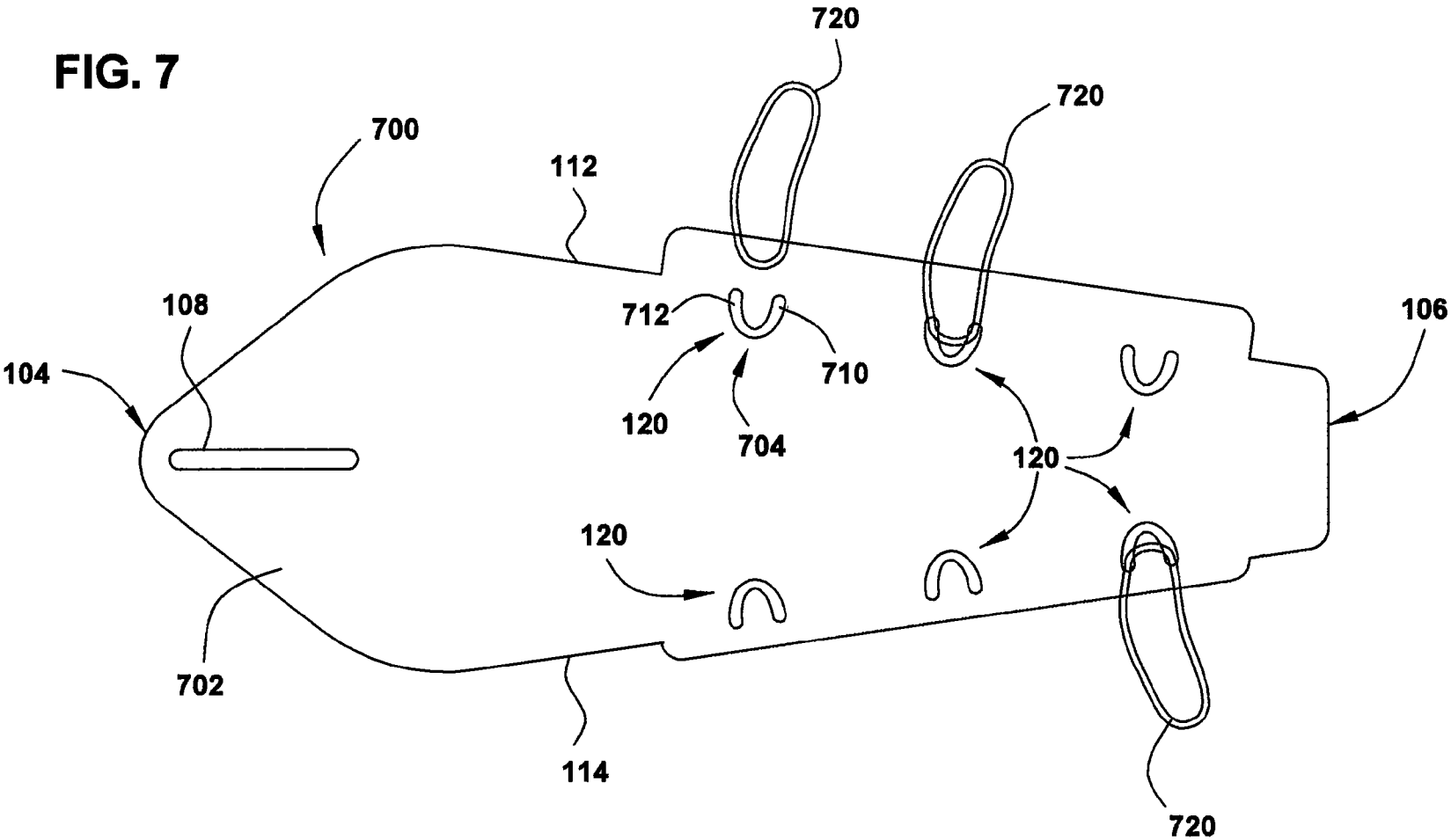
FIG. 7 is a plan view of another embodiment of a tube assembly for hang-drying wet garments shown in a flat orientation.

FIG. 7 depicts another embodiment of a tube assembly 700. The tube assembly 700 is substantially similar to the tube assemblies 100, 600 described above, except wherein the fastening features 120 include closing hooks 704 formed in the body 702 along the lateral sides 112, 114. A band 720 may be secured between the hooks 704 to retain the tube assembly 700 in a rolled position. In one embodiment, the band 704 is a stay having loops at each end. In another embodiment, the band 704 is a loop. In yet another embodiment, the band 704 is a rubber band. It is also contemplated that a rubber band may be slid over the tube assembly to retain the tube assembly in a rolled position.

In the embodiment depicted in FIG. 7, the hook 704 includes a slot 710 formed in the body 702. A protrusion 712 extends into the slot 710 in a direction away from the sides 112, 114. The protrusion 712 catches the band 720 such that the sides 112, 114 may be secured together, thereby creating a roll.

Figure 8:
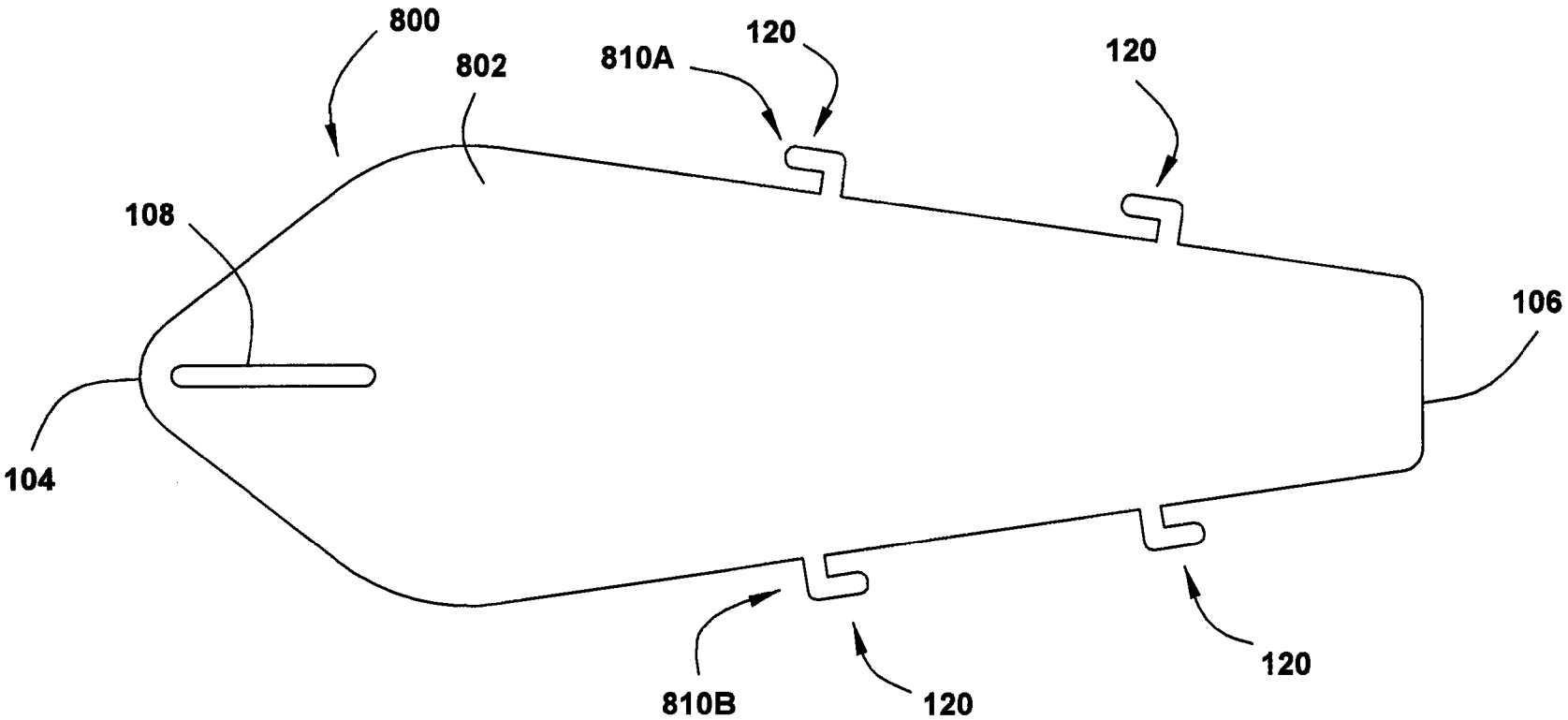
FIG. 8 is a plan view of another embodiment of a tube assembly for hang-drying wet garments shown in a flat orientation.

FIG. 8 is another embodiment of a tube assembly 800. The tube assembly 800 is substantially similar to the tube assemblies 100, 600, 700 described above, except wherein mating features 120 are formed in the body and may be utilized to selectively interlock the tube assembly 800 in a rolled position. It is also contemplated that the tube assemblies described herein may be configured to be substantially cylindrical, such that the tube assembly is not tapered when in a rolled position.

Figure 9:
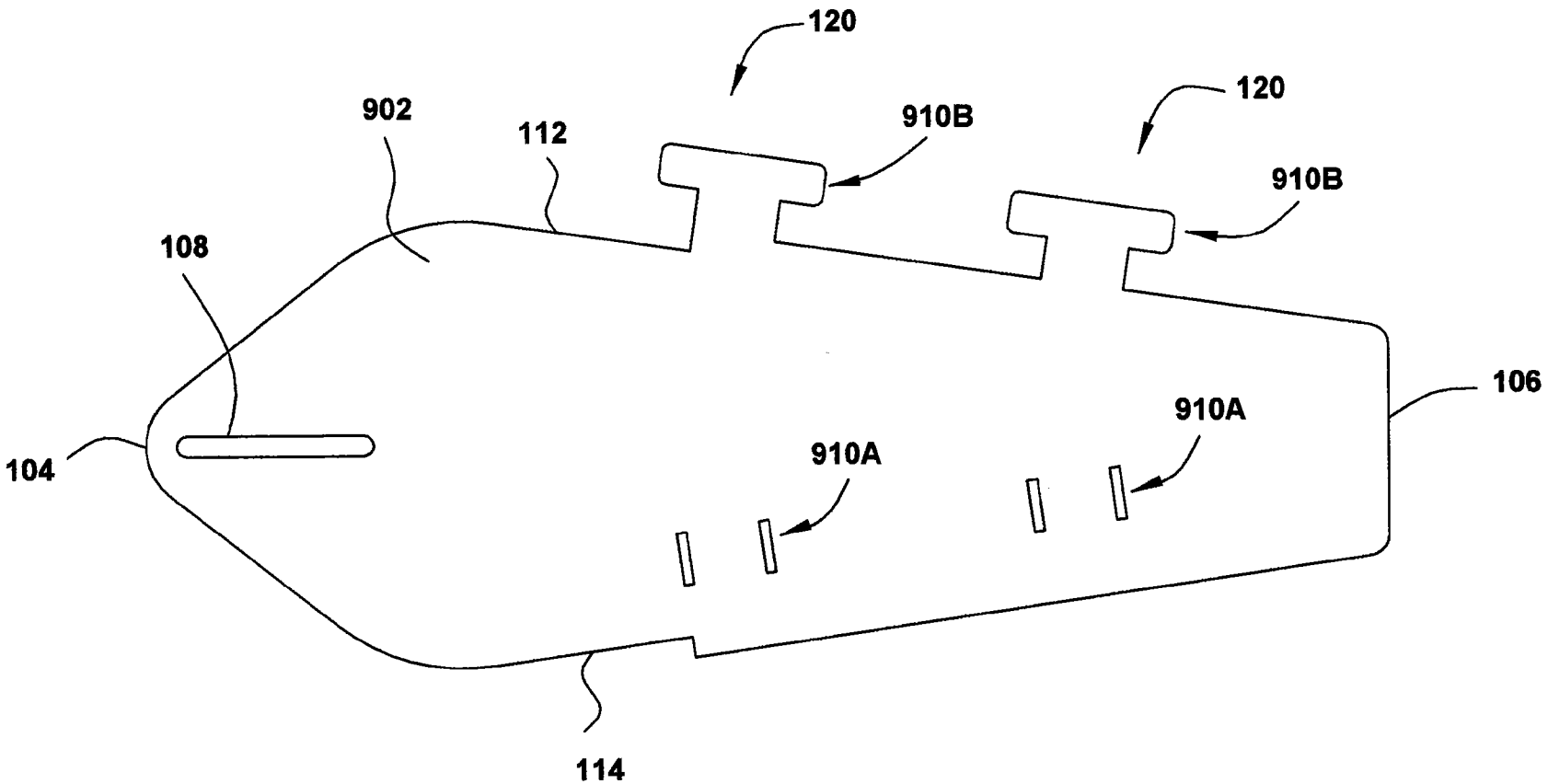
FIG. 9 is a plan view of another embodiment of a tube assembly for hang-drying wet garments shown in a flat orientation.

In the embodiment depicted in FIG. 8, the mating features 120 of the body 802 of the tube assembly 800 includes interlocking features 810A, 810B, such as opposing hooks. In another embodiment as shown in FIG. 9, a tube assembly 900 includes interlocking features 910A, 910B, such as a slot 910A and a tap 910B. The tap 910B is positioned on the body 902 such that when the body 902 is rolled, the tab 910B may be engaged with the slot 910A. It is contemplated that other alternative mating features may be employed to retain the orientation of the tube assembly 900.

Although the teachings of the present invention have been shown and described in detail herein, those skilled in the art can readily devise other varied embodiments that still incorporate the teachings and do not depart from the scope and spirit of the invention.

What is claimed is:

1. An apparatus for drying a garment on a garment hanger, comprising:

a pair of elongated bodies comprised of water resistant sheets, each the body having a major axis extending between a first end and a second end, and each body having an elongated aperture formed in the first end configured to allow a hook of the garment hanger to pass therethrough with the second end extending beyond the garment hanger, wherein the first end has a slot formed opposite the elongated aperture when the elongated body is held in a tubular orientation, the slot having sufficient length to allow the elongated body to pass over an end of the garment hanger while the elongated body is held in the tubular orientation and the hook is extended through the elongated aperture, each body having a length along the major axis greater than about 30 inches.

2. The apparatus of claim 1, wherein each body further comprises a plurality of apertures extending along major axis body.

3. The apparatus of claim 1, wherein each body is comprised of a polymer material that may be changed between a substantially flat first orientation and a substantially tubular second orientation.

4. The apparatus of claim 3 further comprising:

a plurality of securing means configured to selectively retain the bodies in the second orientation.

5. The apparatus of claim 4, wherein the securing means further comprises:

at least two straps, each strap secured at a first end to the body and a second end adapted to selectively secure the body in the second orientation.

6. The apparatus of claim 4, wherein the securing means further comprises:

at least one of a band, a snap, a latch, a hook, tape, a magnet, hook and loop fastener mating features disposed on opposite edges of the body.

7. The apparatus of claim 4, wherein the body further comprises:

tabs extending from opposite edges, the tabs overlapping when the body is secured in the second orientation; and a slot defined between the opposite edges, an end of the slot farthest from the first end bounded by the tabs.

8. The apparatus of claim 1, wherein each body is tapered towards the second end.

9. An apparatus for drying a garment on a garment hanger, comprising:

a pair of elongated bodies comprised of water resistant polymer sheets, each the body having length defined a major axis extending between a first end and a second end greater than about 24 inches, and each body having an aperture formed in the first end configured to allow a hook of the garment hanger to pass therethrough, wherein each body reconfigurable between a substantially flat first orientation and a substantially tubular second orientation, wherein each of the elongated bodies form a slot in the first end opposite the aperture when in the substantially tubular second orientation; and a plurality of securing means configured to selectively retain the bodies in the substantially tubular second orientation, wherein the securing means is at least one of a strap, a band, a snap, a latch, a hook, tape, a magnet, hook and loop fastener mating features disposed on opposite edges of the body.

10. The apparatus of claim 9, wherein each body tapers from the first end to the second end.

11. An apparatus for drying a garment on a garment hanger comprising a hook, two upper members and a cross member, comprising:

an elongated body comprised of a water resistant material, the body having a major axis extending between a first end and a second end, the body repeatably changeable between a substantially flat first orientation and a substantially tubular second orientation, the substantially tubular second orientation aligned with the major axis, the elongated body having opposite edges, each edge having a first portion proximate the first end, the first portions of the opposite sides defining a space therebetween when the elongated body is in the substantially tubular second orientation, the body having a length along the major axis greater than about 30 inches; and an elongated first aperture formed in the first end of the elongated body, the elongated first aperture aligned with the major axis and configured to receive the hook of the garment hanger while the body rests on one of the upper members of the garment hanger, wherein the elongated first aperture is unobstructed by the body along an imaginary line defined through the aperture and normal to a centerline of the elongated body in the substantially tubular second orientation, the imaginary line passing between the first portion of the opposite edges.

12. The apparatus of claim 11, wherein the water resistant material further comprises a polymer.

13. The apparatus of claim 11, wherein the body further comprises a plurality of apertures extending along major axis body.

14. The apparatus of claim 11 further comprising:

a plurality of securing means configured to selectively retain the body in the second orientation.

15. The apparatus of claim 11, wherein the securing means further comprises:

at least two straps, each strap secured at a first end to the body and a second end adapted to selectively secure the body in the second orientation.

16. The apparatus of claim 11, wherein the securing means further comprises:

at least one of a band, a snap, a latch, a hook, tape, a magnet, hook and loop fastener mating features disposed on opposite edges of the body.

17. The apparatus of claim 11, wherein the body tapers from the first end to the second end.

18. The apparatus of claim 11, wherein the body further comprises:

tabs extending from opposite edges, the tabs overlapping when the body is secured in the second orientation; and a slot defined between the opposite edges, an end of the slot farthest from the first end bounded by the tabs.

* * * * *